United States Patent [19]

Budzich

[11] 4,122,677

[45] * Oct. 31, 1978

[54] LOAD RESPONSIVE VALVE ASSEMBLIES

[76] Inventor: Tadeusz Budzich, 80 Murwood Dr., Moreland Hills, Ohio 44022

[ * ] Notice: The portion of the term of this patent subsequent to Oct. 12, 1993, has been disclaimed.

[21] Appl. No.: 709,205

[22] Filed: Jul. 27, 1976

Related U.S. Application Data

[63] Continuation-in-part of Ser. No. 559,818, Mar. 19, 1975, Pat. No. 3,984,979, and a continuation-in-part of Ser. No. 522,324, Nov. 8, 1974, Pat. No. 3,998,134, and a continuation-in-part of Ser. No. 655,561, Feb. 5, 1976.

[51] Int. Cl.[2] ..... F15B 13/08

[52] U.S. Cl. ..... 60/427; 60/445; 91/518; 91/421; 91/436; 91/446; 137/596.1; 137/596.13

[58] Field of Search ..... 60/427, 445; 91/412, 91/421, 436, 446; 137/596.12, 596.13, 596.1

[56] References Cited

U.S. PATENT DOCUMENTS

| | | | |
|---|---|---|---|
| 3,722,543 | 3/1973 | Tennis | 137/596.12 |
| 3,744,517 | 7/1973 | Budzich | 137/596.1 X |
| 3,807,447 | 4/1974 | Masuda | 137/596.13 |
| 3,984,979 | 10/1976 | Budzich | 60/445 |
| 4,020,867 | 5/1977 | Sumiyoshi | 137/596.13 |
| 4,058,140 | 11/1977 | Budzich | 137/596.13 |

*Primary Examiner*—Gerald A. Michalsky

[57] ABSTRACT

A load responsive fluid power multiple load control system using load responsive direction and flow control valves in combination with pump control responding to highest system load. Each direction flow control valve is equipped with a single load responsive controller which automatically regulates fluid flow into and out of the fluid motor to maintain a constant pressure in front of a variable flow controlling orifice, during the control of both positive and negative loads. The load responsive controller of each direction control valve blocks the pump flow to the motor while controlling negative load, providing the motor inlet with fluid from the motor exhaust.

17 Claims, 3 Drawing Figures

LOAD RESPONSIVE VALVE ASSEMBLIES

This is a continuation in part of applications Ser. No. 559,818 filed Mar. 19, 1975 for "Load Responsive Fluid Control Valves" now U.S. Pat. No. 3,984,979, Ser. No. 522,324 filed Nov. 8, 1974 for "Load Responsive Fluid Control Valves" now U.S. Pat. No. 3,998,134 and Ser. No. 655,561 filed Feb. 5, 1976 for "Load Responsive Fluid Control System".

BACKGROUND OF THE INVENTION

This invention relates generally to load responsive fluid control valves and to fluid power systems incorporating such valves, which systems are supplied by a single fixed or variable displacement pump. Such control valves are equipped with an automatic load responsive control and can be used in a multiple load system, in which a plurality of loads is individually controlled under positive and negative load conditions by separate control valves.

In more particular aspects this invention relates to direction and flow control valves capable of controlling simultaneously a number of loads under both positive and negative load conditions.

In still more particular aspects this invention relates to direction and flow control valves capable of controlling simultaneously multiple positive and negative loads, which while controlling a negative load interrupt pump flow to the motor providing the motor inlet with fluid from the pressurized system exhaust.

Closed center load responsive fluid control valves are very desirable for a number of reasons. They permit load control with reduced power losses and therefore, increased system efficiency and when controlling one load at a time provide a feature of flow control irrespective of the variation in the magnitude of the load. Normally such valves include a load responsive control, which automatically maintains pump discharge pressure at a level higher, by a constant pressure differential, than the pressure required to sustain the load. A variable orifice, introduced between pump and load, varies the flow supplied to the load, each orifice area corresponding to a different flow level, which is maintained constant irrespective of variation in magnitude of the load. The application of such a system is, however, limited by several basic system disadvantages.

Since in this system the variable control orifice is located between the pump and the load, the control signal to a pressure regulating throttling device is at a high pressure level inducing high forces in the control mechanism. Another disadvantage of such a control is that it regulates the flow of fluid into the motor and therefore does not compensate for fluid compressibility and leakage across both motor and valve. Still another disadvantage of such a control is that timing of the valve and sequencing of operations must be very exact to prevent cavitation in the motor and to prevent the motor from being subjected to excessive pressures during control of negative loads. A fluid control valve for such a system is shown in U.S. Pat. No. 3,488,953 issued to Haussler.

Normally the load responsive valve control can maintain a constant pressure differential and therefore constant flow characteristics when operating only one load at a time. With two or more loads, simultaneously controlled, only the highest of the loads will retain the flow control characteristics, the speed of actuation of lower loads varying with the change in magnitude of the highest load. The drawback can be overcome in part by the provision of a proportional valve as disclosed in my U.S. Pat. No. 3,470,694 dated Oct. 7, 1969 and also in U.S. Pat. No. 3,455,210 issued to Allen on July 15, 1960. However, while those valves are effective in controlling positive loads they do not retain flow control characteristics when controlling negative loads, which instead of taking, supply the energy to the fluid system and hence the speed of actuation of such a load in a negative load system will vary with the magnitude of the negative load. Especially with so-called overcenter loads, where a positive load may become a negative load, such a valve will lose its speed control characteristics in the negative mode.

This drawback can be overcome by the provision of a load responsive fluid control valve as disclosed in my U.S. Pat. No. 3,744,517 issued July 10, 1973 and my U.S. Pat. No. 3,882,896 issued May 13, 1975. However, while these valves are effective in controlling both positive and negative loads, with pump pressure responding to the highest pressure of a system load being controlled, they still utilize a controlling orifice located between the pump and the motor during positive load mode of operation and therefore control the fluid flow into the fluid motor instead of controlling fluid flow out of the fluid motor.

This drawback can be overcome by provision of load responsive fluid control valves as disclosed in my pending patent application Ser. No. 522,324 filed Nov. 8, 1974, now U.S. Pat. No. 3,998,134, entitled "Load Responsive Fluid Control Valves". However, while such valves maintain the pump discharge pressure higher, by a constant pressure differential, than the highest load pressure of system loads being controlled and are effective in controlling multiple positive loads, while maintaining a relatively constant down stream pressure at the motor exhaust, during control of negative loads whose valves supply the motor inlet with throttled down fluid from the pump circuit, therefore using flow from the pump, while controlling a negative load. In certain fluid power control systems it is preferable, while controlling a negative load, to supply fluid to the motor inlet from the motor exhaust circuit instead of using pump capacity.

This drawback can be overcome in part by provision of fluid control valves as disclosed in U.S. Pat. No. 3,807,447 issued to Masuda on Apr. 30, 1974. However, while those valves utilize actuator exhaust fluid for actuator inlet flow requirement when controlling negative loads they regulate actuator inlet pressure by bypassing fluid to a down stream load circuit. Masuda's valves and their proportional control system are based on series type circuit in which excess fluid flow is successively diverted from one valve to the other and in which loads arranged in series determine the system pressure. In such a system flow to the last valve operating a load must be delivered through all of the bypass sections of all of the other system valves, resulting in higher fluid throttling loss. These valves are not adaptable to simultaneous control of multiple loads in parallel circuit operation since they do not provide system load control pressure signal to the pump flow control mechanism. When used with variable displacement pumps these valves are not capable of providing sufficient pressurized exhaust flow to actuator inlet during control of negative load to prevent cavitation.

SUMMARY OF THE INVENTION

It is therefore a principal object of this invention to provide a load responsive fluid control system in which improved load responsive fluid direction and flow control valves block system pump from motor inlet and supply it with system exhaust flow when controlling negative loads, while transmitting control signals to system pump to maintain the pressure of the system pump higher, by a constant pressure differential, than the highest pressure of the system positive load being controlled.

Another object of this invention is to provide a load responsive fluid control system in which load responsive fluid direction and flow control valves are provided with a pressurized exhaust manifold, flow from which supplies the inlet flow requirements of motors controlling negative loads, the system pump being utilized to prevent pressure in the exhaust manifold dropping below a certain predetermined level.

It is another object of this invention to provide a load responsive fluid control system in which load responsive fluid direction and flow control valves retain their control characteristics during control of positive and negative loads, while maintaining a low relatively constant pressure in front of a variable flow controlling orifice.

It is a further object of this invention to provide a load responsive fluid control system in which load responsive fluid direction and flow control valves are provided with positive and negative load controls, the positive load controls having a priority feature permitting control of down stream valves, while the valve with priority feature is not being used.

Briefly the foregoing and other additional objects and advantages of this invention are accomplished by providing a novel load responsive fluid control system for use during proportional simultaneous control of multiple positive and negative loads. A system pump is controlled in respect to pressure signal transmitted from system valves, corresponding to the highest system load pressure. Exhaust circuit of the system is pressurized, the exhaust flow being used to provide inlet flow requirements of motors controlling negative loads. Valves with priority feature permit, while inactive, operation of the down stream valves.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
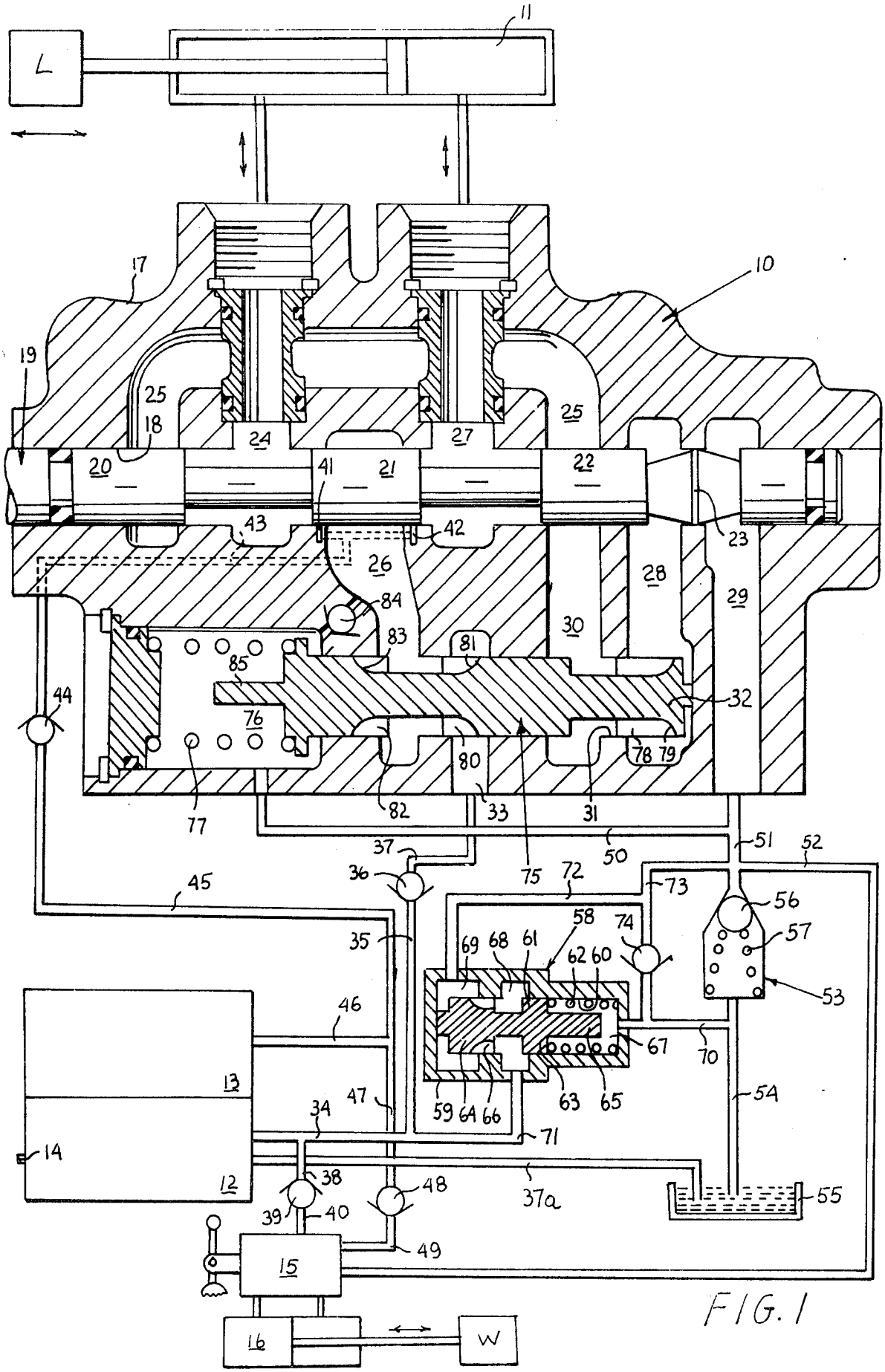
FIG. 1 is a longitudinal sectional view of an embodiment of a flow control valve having a positive and negative load control responsive to actuator down stream pressure for use in load responsive fluid control system with pressure signal lines, common exhaust manifold with its exhaust relief valve, constant pressure reducing valve, pressure compensated variable displacement pump, reservoir and other load responsive valve shown diagrammatically.

Referring now to the drawings and for the present to FIG. 1, one embodiment of a load responsive flow control valve, generally designated as 10, is shown interposed between a diagramatically shown first fluid motor 11 driving a load L and a variable displacement pump 12, equipped with a load responsive differential pressure compensator control 13, well known in the art. The differential pressure compensator 13 may be, in a conventional way, mounted directly on the variable displacement pump 12 or can be made a part of the valve assembly. If the differential pressure compensator 13 is made part of the valve assembly it is connected to the variable displacement pump 12 by three lines, one line at pump discharge pressure, one line at the reservoir pressure and one line for conducting of a modulated control signal to the displacement changing mechanism of the variable displacement pump 12. The load responsive differential pressure compensator control 13, in a well known manner, automatically varies displacement of the variable displacement pump 12, to maintain a constant pressure differential between pump discharge pressure and maximum system load pressure being controlled. The variable displacement pump 12 is driven through a shaft 14 by a suitable prime mover not shown. Another load responsive flow control valve 15, identical to the load responsive flow control valve 10, is interposed between the variable displacement pump 12 and a second fluid motor 16 driving a second load W.

The load responsive flow control valve 10 is of a four-way type and has a housing 17 provided with a bore 18, axially guiding a valve spool 19. The valve spool 19 is equipped with isolating lands 20, 21 and 22 and a metering land 23. With the valve spool 19 in neutral position as shown in FIG. 1, land 20 isolates a load chamber 24 from an outlet chamber 25, land 21 isolates a supply chamber 26 from load chambers 24 and 27, land 22 isolates the outlet chamber 25 from the load chamber 27 and a first exhaust chamber 28 and metering land 23 isolates the first exhaust chamber 28 from a second exhaust chamber 29. The outlet chamber 25 is cross-connected through passage 30 and bore 31, guiding a control spool 32, to the first exhaust chamber 28. The supply chamber 26 is cross-connected through bore 31 and the control spool 32 to an inlet chamber 33. The outlet of the variable displacement pump 12 is connected through discharge lines 34 and 35, check valve 36 and line 37 to the inlet chamber 33. Similarly, the outlet of the variable displacement pump 12 is connected through discharge line 38, a check valve 39 and line 40 to the load responsive flow control valve 15. Variable displacement pump 12 is connected by suction line 34a with system reservoir 55. Pressure sensing ports 41 and 42, blocked in neutral position of the valve spool 19 by land 21, are connected through line 43, a check valve 44 and lines 45 and 46 with the load responsive differential pressure compensator control 13, which can be an integral part of the variable displacement pump 12 or can be a part of the flow control valve 10. Similarly the differential pressure compensator control 13 is connected through line 47, a check valve 48 and line 49 with the load sensing ports of the flow control valve 15. Exhaust lines 50, 51 and 52 form an exhaust manifold connecting the combined exhaust flow of flow control valves 10 and 15 with an exhaust relief valve, generally designated as 53, which is connected through line 54 with the system reservoir 55. The exhaust relief valve 53 is provided with a throttling member 56 biased by a spring 57. A pressure reducing valve, generally designated as 58, has a housing 59 provided with a valve bore 60, axially guiding a valve spool 61, which is biased towards position as shown in FIG. 1 by a spring 62. The valve spool 61 is provided with lands 63 and 64, stop 65 and throttling grooves 66. The valve housing 59 is provided with space 67 and chambers 68 and 69. Space 67 is connected through lines 70 and 54 with the reservoir 55. The chamber 68 is connected by line 71 with discharge line 34, which is supplied with fluid under pressure from the variable displacement pump 12. The chamber 69 is connected by lines 72 and 73 with exhaust line 51 and therefore with system exhaust manifold of flow control valves 10 and 15. This system exhaust manifold is also connected through line 73, a check valve 74 and lines 70 and 54 with the reservoir 55.

A fluid throttling control, generally designated as 75, has the control spool 32 guided in bore 31. At one end, (the right as viewed in FIG. 1) the control spool 32 is subjected to pressure existing in the first exhaust chamber 28. The other end of the control spool 32, communicating with exhaust space 76, is subjected to pressure existing in space 76 and the biasing force of the control spring 77. The control spool 32 is equipped with first throttling slots 78 terminating in throttling edges 79, communicating the outlet chamber 25 with the first exhaust chamber 28, second throttling slots 80 equipped with throttling edges 81, communicating the inlet chamber 33 with the supply chamber 26 and bypass slots 82 equipped with control surface 83 located between the supply chamber 26 and exhaust space 76. Exhaust space 76 is connected with the supply chamber 26, for one way flow, by a suction check valve 84. Increase in pressure differential between the first exhaust chamber 28 and exhaust space 76, acting on the cross-sectional area of the control spool 32, will first balance the preload of the control spring 77 and then move the control spool 32 from right to left. The location of throttling slots is such that initial movement of the control spool 32 will gradually reduce the passage area between the inlet chamber 33 and the supply chamber 26, throttling the fluid flow between these chambers, until the passage between these two chambers closes. Further movement of the control spool 32 to the left will connect the supply chamber 26 with exhaust space 76 by control surface 83, while full flow passage is still maintained between the outlet chamber 26 and the first exhaust chamber 28, through first throttling slots 78. Still further movement of the control spool 32 to the left will gradually reduce the passage between the outlet chamber 25 and the first exhaust chamber 28, throttling the fluid flow between these chambers, until throttling edges 79 will close the passage between these two chambers. This movement of the control spool 32 to the left will also gradually increase the area of communication between the supply chamber 26 and exhaust space 76 through bypass slots 82, while still isolating the inlet chamber 33 from the supply chamber 26.

Preferably the size and position of lands of the valve spool 19 are such that movement of the valve spool 19 to the right, from the position as shown, will simultaneously connect the load chamber 24 with the pressure sensing port 41 and the load chamber 27 with the outlet chamber 25 and then connect the supply chamber 26 with load chamber 24, while metering land 23 still isolates the first exhaust chamber 28 from the second exhaust chamber 29. Further movement of the valve spool 19 to the right through displacement of metering land 23 will gradually open passage between the first exhaust chamber 28 and the second exhaust chamber 29, the area of fluid flow between these two chambers gradually increasing with displacement of valve spool 19. Movement of valve spool 19 to the left will first simultaneously connect the load chamber 27 with the pressure sensing port 42 and the load chamber 24 with the outlet chamber 25 and then connect the supply chamber 26 with the load chamber 27. Further movement of the valve spool 19 to the left through displacement of metering land 23 will gradually open passage between the first exhaust chamber 28 and the second exhaust chamber 29, the area of flow between these two chambers gradually increasing with displacement of valve spool 19.

Assume that the valve spool 19 is moved from left to right, from the position shown in FIG. 1. This will communicate the load chamber 24 with the pressure signal port 41 and the load chamber 27 with the outlet chamber 25, while the metering land 23 still isolates the first exhaust chamber 28 from the second exhaust chamber 29. Assume also that the load chamber 24 is subjected to pressure of positive load. High pressure fluid will be transmitted through the pressure sensing port 41, line 43, and opening the check valve 44 will be further transmitted through lines 45 and 46 to the differential pressure compensator control 13 of variable displacement pump 12. This high pressure fluid conducted through line 47 will also close the check valve 48. In a well known manner the differential pressure compensator 13 will vary the displacement of the variable displacement pump 12, to maintain a pressure in discharge line 34, at a level higher by a constant pressure differential than the positive load pressure in the load chamber 24. Since the load chamber 24 is subjected to a positive load the load chamber 27, connected by displacement of the valve spool 19 to the outlet chamber 25, will be subjected to zero pressure.

Assume that the valve spool 19 is further moved from left to right connecting the supply chamber 26 with the load chamber 24, while metering land 23 still isolates the first exhaust chamber 28 from the second exhaust chamber 29. Increase in the pressure in the load chamber 24 will overcome the resistance of load L. Since the outlet of the fluid motor 11 is connected through load chamber 27 and the outlet chamber 25 to the first exhaust chamber 28 which is blocked by metering land 23, in a well known manner, pressure in the load chamber 27, the outlet chamber 25, and the first exhaust chamber 28 will begin to rise. This increased pressure in the first exhaust chamber 28 will equal the difference between the pressure in the load chamber 24 (which is connected to supply chamber 26) and the pressure necessary to support the load L. Increase in pressure in the first exhaust chamber 28, reacting on the cross-sectional area of the spool 32 will reach a force level which will overcome the preload in the control spring 77 and will move the control spool 32 to the left, closing the passage between the inlet chamber 33 and the supply chamber 26 and interrupting the supply of high pressure fluid to the supply chamber 26 and the load chamber 24. Subjected to the force of the pressure differential, existing between the first exhaust chamber 28 and exhaust space 76 and the biasing force of the control spring 77 the spool 32 of throttling control valve 75 will modulate to maintain a relatively constant pressure differential between first exhaust chamber 28 and exhaust space 76, by regulating the pressure level in the supply chamber 26 and load chamber 24. This relatively constant controlled pressure differential between first exhaust chamber 28 and exhaust space 76 will be approximately equal to the quotient of the preload in control spring 77 at the control position of spool 32 and the cross-sectional area of spool 32. Any rise in pressure in the first exhaust chamber 28, over that equivalent to the relatively constant controlled pressure differential level, will move the spool 32 to the left into a new modulating position, to relieve some of the pressure in the supply chamber 26, by cross-connecting it through bypass slots 82 with exhaust space 76, while maintaining passage between the inlet chamber 33 and the supply chamber 26 closed. Conversely, any decrease in the pressure in the first exhaust chamber 28 below that, equivalent to the relatively constant controlled pressure differential level, will move the spool 32 to the right, first closing communication between the supply chamber 26 and exhaust space 76 and then gradually connecting the supply chamber 26 with high pressure fluid in the inlet chamber 33. Therefore the throttling control 75 will automatically regulate the pressure in the first exhaust chamber 28 to maintain a relatively constant controlled pressure differential between the first exhaust chamber 28 and exhaust space 76. With pressure in exhaust space 76 remaining constant the throttling control 75 will automatically maintain the pressure in the first exhaust chamber 28 at a level to retain a relatively constant pressure differential between the first exhaust chamber 28 and exhaust space 76, approximately equivalent to the quotient of the biasing force of the control spring 77 and the cross-sectional area of the spool 32.

Further movement of valve spool 19 to the right, through the displacement of metering land 23, will create an orifice between the first exhaust chamber 28 and the second exhaust chamber 29. Fluid flow will take place through the orifice between these chambers, momentarily lowering pressure in the first exhaust chamber 28. The spool 32 of throttling control 75 will change its modulating position, moving from left to right, creating an opening between the inlet chamber 33 and the supply chamber 26 through second throttling slots 80, throttling the fluid flow between those chambers, to maintain the pressure differential between the first exhaust chamber 28 and exhaust space 76 at a relatively constant level. Exhaust space 76 is connected through exhaust line 50 with the second exhaust chamber 29. Therefore a relatively constant pressure differential will also be maintained by the throttling control 75 between the first exhaust chamber 28 and the second exhaust chamber 29. Since the flow through the orifice at the metering land 23 is proportional to the orifice area, once a relatively constant pressure differential is maintained across the orifice, and since this pressure differential is automatically maintained relatively constant by the throttling control 75, the flow between the first exhaust chamber 28 and the second exhaust chamber 29 will also be relatively constant for any specific position of valve spool 19 and independent of the load pressure in the load chamber 24. Therefore each specific position of valve spool 19, corresponding to a specific orifice area between first exhaust chamber 28 and second exhaust chamber 29, will also correspond to a specific controlled flow level through the load responsive flow control valve 10. The fluid throttling control 75 maintains a relatively constant pressure differential between first exhaust chamber 28 and second exhaust chamber 29, the flow control therefore being independent of the pressure level in the second exhaust chamber 29. While throttling the fluid flow between the inlet chamber 33 and the supply chamber 26, to maintain a relatively constant pressure differential between first and second exhaust chambers, the spool 32 maintains full flow passage between the outlet chamber 25 and the first exhaust chamber 28, through first throttling slots 78. A sudden increase or decrease in load L, through corresponding momentary decrease or increase in pressure in the first exhaust chamber 28, will result in the change in throttling position of the spool 32. In each case with the condition of force equilibrium established, the pressure differential between first and second exhaust chambers will return to its relatively constant controlled level, with the spool 32 modulating in each new position.

The exhaust fluid flow from the second exhaust chamber 29 is transmitted through exhaust line 51 to the low pressure exhaust relief valve 53, which permits the exhaust flow to reach the reservoir 55, while maintaining constant minimum pressure level in the second exhaust chamber 29, equivalent to the preload of the spring 57. This constant minimum pressure level maintains the check valve 74 in a closed position. Since the pressure in the exhaust space 76 is maintained at a constant level by the exhaust relief valve 53, the throttling control 75 throttles flow of fluid through flow control valve 10 to maintain pressure in the first exhaust chamber 28 at a constant level for any specific position of the valve spool 19.

Assume that the valve spool 19 is moved from left to right from its neutral position as shown in FIG. 1, connecting first the load chamber 27 with the outlet chamber 25 and the load chamber 24 with the pressure sensing port 41, while land 21 still isolates supply chamber 26 from load chamber 24 and metering land 23 isolates the first exhaust chamber 28 from the second exhaust chamber 29. Assume also that load chamber 27 is subjected to pressure of a negative load. Low pressure signal will be transmitted from pressure sensing port 41 to the differential pressure compensator, in a well known manner, bringing the variable displacement pump to its minimum standby pressure level. Negative load pressure from the outlet chamber 25 will be transmitted through passage 30 and first throttling slots 78 to the first exhaust chamber 28, where it will react on the cross-sectional area of the spool 32 moving it all the way from right to left, compressing the control spring 77 and engaging stop 85. In this position the spool 32 will isolate the first exhaust chamber 28 from the outlet chamber 25, isolate the inlet chamber 33 from the supply chamber 26 and connect the supply chamber 26 with exhaust space 76. When, due to leakage across the metering land 23, which can normally be expected, the pressure in the first exhaust chamber 28 drops to a level, equivalent to the biasing force of the compressed control spring 77, the spool 32 will move to the right and start to modulate, throttling the fluid flow from the outlet chamber 25 to maintain a relatively constant pressure in the first exhaust chamber 28, the passage between the inlet chamber 33 and the supply chamber 26 remaining blocked and the supply chamber 26 remaining open through bypass slots 82 to exhaust space 76.

Further movement of the valve spool 19 to the right will first connect the supply chamber 26 with the load chamber 24, both of which are subjected to low pressure, and then through displacement of metering land 23 will open an orifice between the first exhaust chamber 28 and the second exhaust chamber 29. The resulting flow between these chambers will momentarily lower the pressure in the first exhaust chamber 28, causing an unbalance of forces acting on the spool 32. As a result the spool 32 will move from left to right throttling fluid flow from outlet chamber 25 to space 76, the outlet chamber being subjected to pressure of the negative load, to maintain a relatively constant pressure differential between the first exhaust chamber 28 and exhaust space 76 and therefore also a relatively constant pressure differential between first and second exhaust chambers, while the fluid flow through the orifice between those chambers takes place. The spool 32 will modulate to maintain a relatively constant pressure differential between the first exhaust chamber 28 and the second exhaust chamber 29 in a position, at which first throttling slots 78 are partially closed and control spring 77 further compressed and exerting higher biasing force. The relatively constant controlled pressure differential between the first exhaust chamber 28 and exhaust space 76 is approximately equal to the quotient of biasing force of the control spring 77 and the cross-sectional area of spool 32. Therefore, when controlling a negative load, spool 32 will maintain a relatively constant control pressure differential at a higher level than the controlled pressure differential when controlling a positive type load. As previously described the position of the valve spool 19 and its metering land 23, which may be of a conical shape as shown or may be equipped with conventional metering slots, will determine the area of the orifice between the exhaust chambers and therefore the controlled flow level through the load responsive flow control valve 10 during control of negative load.

Since as previously described, the pressure in the second exhaust chamber 29 is maintained constant by the exhaust relief valve 53, when controlling a positive load the pressure in the first exhaust chamber 28 will be maintained at a first relatively constant pressure level and when controlling a negative load the pressure in the first exhaust chamber 28 will be maintained at a second relatively constant pressure level, the second relatively constant pressure level being higher than the first relatively constant pressure level due to greater force exerted by the compressed control spring 77.

The displacement of the fluid from the fluid motor 11 requires equivalent fluid flow into the fluid motor 11 to prevent cavitation. When controlling a negative load the spool 32 isolates the inlet chamber 33 from the supply chamber 26 but connects the supply chanber 26 with exhaust space 76. The fluid motor exhaust fluid flows from second exhaust chamber 29 through exhaust lines 51 and 50 into exhaust space 76, from which it can follow two paths on its way to the load chamber 24 and fluid motor 11. The fluid can flow from exhaust space 76 through bypass slots 82 to the supply chamber 26 and load chamber 24. The fluid can also flow from exhaust space 76 through suction check valve 84 to the supply chamber 26 and to the load chamber 24. If the fluid flow from the second exhaust chamber 29 is higher than the flow requirement of load chamber 24, part of this flow will be diverted through low pressure exhaust relief valve 53 and therefore fluid will be supplied to load chamber 24 at a pressure, equivalent to setting of low pressure exhaust relief valve 53. However, if the flow requirement of the load chamber 24 exceeds the flow from the second exhaust chamber 29, the additional flow is supplied from reservoir 55 through lines 54 and 70, check valve 74 and exhaust lines 73, 51 and 50 to the exhaust space 76. Under these conditions the load chamber 24 is subjected to a pressure lower than atmosospheric pressure and the fluid motor 11 might cavitate.

In FIG. 1 since the pump 12 is of a variable displacement type, it supplies the exact amount of fluid to satisfy the system demand, none of the pump flow being diverted to exhaust line 50. Normally an actuator, in the form of a cylinder, due to presence of piston rod, displaced different flows from each cylinder port per unit length displacement of its piston. Therefore, while controlling negativeload, the exhaust flow out of the cylinder might be substantilly smaller than its inlet flow reqirements. Under these conditions, since communication between the inlet chamber 33 and the supply chamber 26 is blocked by the control spool 32, exhaust pressure level, as maintained by the exhaust pressure relief valve 53 will drop below atmospheric pressure, the exhaust pressure relief valve 53 will close entirely and cavitation will take place at the inlet side of the cylinder. To prevent cavitation and to maintain exhaust line 50 at minimum pressure level a pressure reducing valve, generally designated as 58, is provided. Fluid under pressure is supplied from the variable displcement pump 12, discharge line 34 and line 71 to the chamber 68 and through throttling grooves 66 to the chamber 69, which is connected by line 72 with exhaust line 73. Pressure in the chamber 69 and in the exhaust manifold will begin to rise and reacting on the cross-sectional area of valve spool 61 will tend to move it from left to right, compressing the spring 62 and closing the passage through throttling grooves 66 between chambers 69 and 68. In this way pressure reducing valve 58, will throttle fluid flow from chamber 68 to chamber 69 and therefore to exhaust line 72, to maintain exhaust line 50 at at constant pressure, as dictated by the preload in the spring 62. This constant controlled pressure level is selected below controlled pressure level of the exhaust pressure relief valve 53. As long as the exhaust pressure relief valve 53 maintains the exhaust system as its controlled pressure level, communication between chambers 68 and 69, of pressure reducing valve 58, wll be closed and no flow from the variable displacement pump 12 will be diverted into the exhaust circuit, to maintain it at a minimum constant pressure level. However, during control of negative load once the actuator inlet flow requirement will exceed the actuator outlet flow, the exhaust pressure relief valve 53 will close, pressure in the exhaust system will drop to the control pressure setting of the pressure reducing valve 58 and the motor exhaust flow will be supplemented from the pump circuit by the pressure reducing valve 58, to maintain the actuator inlet at the required pressure. Therefore during control of negative load only the difference between the actuator inlet flow requirement and the actuator exhaust flow will be supplied to the exhaust circuit from the variable displacement pump 12. This feature not only improves the efficiency of the system, but greatly extends the capacity of the pump of variable displacement type, to perform useful work in control of positive loads.

If the valve spool 19 is moved from right to left, function of the load chambers 24 and 27 is reversed, for opposite directin of drive, but the valve functions in the same manner as described above.

The load responsive flow control valve 10 of FIG. 1 is capable of controlling both positive and negative loads, the flow through the valve being proportional to the position of the metering land 23 and therefore position of valve spool 19, irrespective of the magnitude of the controlled load both in positive and negative modes of load operation and in either direction of flow and therefore either direction of the movement of the fluid motor.

Since during control of negative load, in flow control valve of FIG. 1, the outlet of the variable displacement pump 12 is cut off from the supply chamber 26 and therefore from the inlet side of the motor 11 by the control spol 32 and since the inlet flow requirement of the fluid motor 11 is supplied from the exhaust manifold of the flow control valves 10 and 15, none of the pump flow is used during control of negative load. This feature not only greatly improves the efficiency of the system but also extends the pump capacity to perform useful work.

Assume that the valve spool 19 is moved very fast from left to right, connecting the load chamber 24 with the supply chamber 26, the load chamber 27 with the outlet chamber 25 and through the metering land 23 connecting the first exhaust chamber 28 with the second exhaust chamber 29. If the differential pressure compensator 13, of the variable displacement pump 12, would not respond fast enough to raise the pump discharge pressure to the required level, a back flow from the load chamber 24 to the variable displacement pump 12 could take place, resulting in a small drop in load L. This back flow is prevented by the check valve 36, which closes communication between the fluid motor 11 and the variable displacement pump 12, until the pump control responds, raising the pump discharge pressure to the required level, as dictated by the control pressure signal, transmitted from the pressure sensing port 41. Once the discharge pressure of the variable pump will become greater than the pressure in the load chamber 24 the check valve 36 will open and the control will resume its normal mode of operation.

Figure 2:
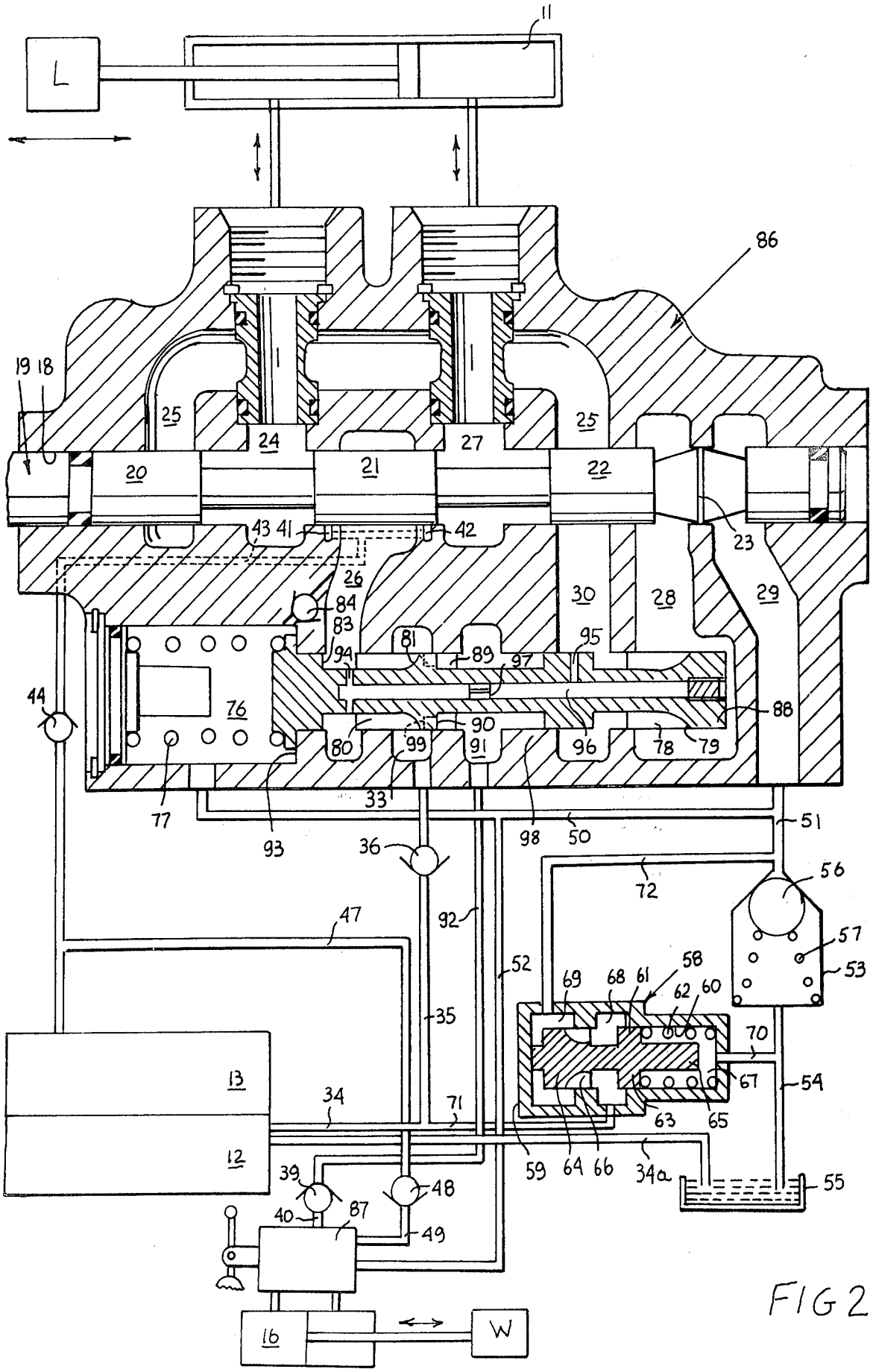
FIG. 2 is a sectional view of a similar embodiment of flow control valve of FIG. 1 having a positive load control with priority feature and negative load control responsive to actuator down stream pressure with pressure signal lines, common exhaust manifold with its exhaust relief valve, constant pressure reducing valve, pressure compensated variable displacement pump, reservoir and other load responsive valve shown diagramatically.

Referring now to FIG. 2, flow control valves, generally designated as 86 and 87, are similar to flow control valves 10 and 15 of FIG. 1 and they perform their control functions in control of loads L and W in a similar way. A control spool 88 of FIG. 2 is similar to the control spool 32 of FIG. 1 and has indentical sections for control of positive and negative loads. However, the control spool 88 is also equipped with bypass slots 89 having throttling edges 90 between a bypass chamber 91 and the inlet chamber 33. The bypass chamber 91 is connected through line 92, check valve 39 and line 40 with the inlet chamber of flow control valve 87.

The sequencing of the control spool 88 is such, that when moved fron right to left, from the position as shown in FIG. 2, it will first open communication through throttling edges 90 between the inlet chamber 33 and the bypass chamber 91, while full flow passage still exists through slots 80 between the inlet chamber 33 and the supply chamber 26 and through slots 78 between the first exhaust chamber 28 and the outlet chamber 25. Further movement of the control spool 88 from right to left will gradually enlarge flow passage between the bypass chamber 91 and the inlet chamber 33, while proportionally reducing flow passage between the inlet chamber 33 and the supply chamber 26, until throttling edges 81 will disrupt communication between the inlet chamber 33 and the supply chamber 26, with control surface 83 positioned in the plane of flow surface 93, at the point of opening communication between the supply chamber 26 and exhaust space 76, while full flow communication still exists, through slots 78, between the outlet chamber 25 and the first exhaust chamber 28. Further movement of the control spool 88 from right to left will gradually close, with throttling edges 79, communication between the first exhaust chamber 28 and the outlet chamber 25, while full flow communication between exhaust space 76 and the supply chamber 26 is established.

The control spool 88 is also equipped with passages 94 and 95 connected by passage 96 containing a restriction orifice 97. A web 98 separates the outlet chamber 25 from the bypass chamber 91. The passage 94 cmmunicates with the inlet chamber 33 and passage 95 communicates with the outlet chamber 25, with spool 88 in position as shown in FIG. 2. With control spool 88 in position as shown in FIG. 2 throttling edges 90 of slots 89 isolate the bypass chamber 91 from the inlet chamber 33. The configurations of valve spools 19 and the load sensing circuits of the flow control valve 10 of FIG. 1 are identical to that of flow control valve 86 of FIG. 2.

With the pump 12 of a variable displacement type, in a well known manner, as previously described, the differential pressure compensator 13 maintains discharge line 34 at minimum standby pressure level. The pump discharge pressure from the inlet chamber 33 is transmitted through passage 94, restriction orifice 97, passages 96 and 95 to the outlet chamber 25 and the first exhaust chamber 28. With the valve spool 19 in its neutral position as shown in FIG. 2 the outlet chamber 25 and the first exhaust chamber 28 are isolated. The rising pressure in the first exhaust chamber 28, reacting on the cross-sectional area of control spool 88, will generate sufficient force to move the control spool 88 against biasing force of control spring 77 to a position, at which passage 95 becomes blocked by guiding surface of web 98. In this position the control spool 88 will interconnect the bypass chamber 91 with the inlet chamber 33, while communication between the inlet chamber 33 and the supply chamber 26 is still maintained. Therefore as long as the pump 12 is generating pressure it is directly connected through the inlet chamber 33, the bypass chamber 91 and line 92 with the inlet chamber of flow control valve 87.

During the control of single or multiple negative or positive loads the flow control valves of FIG. 2 will perform in an identical way as the flow control valves of FIG. 1. There is however one additional function that the flow control valve 86 of FIG. 2 can perform and this relates to priority control feature of the valve.

Assume that during simultaneous control of positive loads L and W by flow control valves 86 and 87 with valve spools moved from left to right, load L becomes the higher of the two. Assume also that the combined flow demand of the flow control valves 86 and 87 will exceed the capacity of the pump 12. Pump pressure in discharge line 34 will start dropping below the level of the constant pressure differential maintained by the differential pressure compensator 13 and therefore the difference between pressure due to load L and pressure in discharge line 34 will decrease. As a result the force equilibrium acting on the control spool 88 will be disturbed. The control spool 88, under action of force developed on its cross-section area by pressure in the first exhaust chamber 28, will move from left to right, moving throttling edges 81 out of their throttling position and throttling with throttling edges 90 fluid flow from the inlet chamber 33 to the bypass chamber 91. In this way flow control spool 88, by throttling action of the throttling edges 90, will maintain a constant pressure in the first exhaust chamber 28, this constant control pressure being maintained by regulating the bypass flow to the actuator 16. Due to this bypass throttling action the flow control valve 86 has a priority feature, which permits proportional control of load L, when the combined flow demand of flow control valves 86 and 87 exceeds the flow capacity of the pump 12. If during simultaneous control of loads L and W, load W is the higher of the two and when flow demand of the flow control valves 86 and 87 exceeds the capacity of the pump 12, the system pressure will drop to a level, equivalent to load pressure L, at which time, in a manner as previously described, the control spool 88 will regulate, by throttling with the throttling edges 90, the bypass flow from the inlet chamber 33 to the bypass a chamber 91, to maintain a constant pressure in the first exhaust chamber 28. Therefore, irrespective of the variation in the magnitude of the loads L and W, during simultaneous operation of flow control valves 86 and 87, once the combined flow demand of the flow control valves exceeds the capacity of the pump 12, the flow control valve 86 always retains the priority feature. Since the pressure in exhaust space 76 is maintained at a constant level by the exhaust relief valve 53 the control valve 88 throttles flow of fluid through flow control valve 86 to maintain pressure in the first exhaust chamber 28 at a constant preselected level.

While controlling positive and negative loads the passage 95 is normally blocked by the guiding surface of the web 98 and therefore no flow takes place through the restriction orifice 97. Therefore the arrangement of passages 94, 95 and 96 with the restricting orifice 97 serves only one purpose and that is to connect the inlet chamber 33 with the bypass chamber 91, with the valve spool 19 of the flow control valve 86 in its neutral position. During normal operation of the control spool 88 when controlling positive or negative loads the flow transfer action of passages 94 and 95 stops. During the control of positive priority type load the small flow from passage 94 to passage 95 through restriction orifice 97 is insignificant, due to the fact that, the metering land 23 connects the first exhaust chamber 28 and the second exhaust chamber 29.

When elongating the bypass slots 89 by slots 99 shown in dotted lines, permanent communication is established between the bypass chamber 91 and the inlet chamber 33. With control spool 88 modified in this way the control of flow of control valve 86 is changed from series to parallel and the priority feature, described when referring to FIG. 2 is lost. In parallel circuit arrangement of control spool 88, inlet chamber 33 and bypass chamber 91 of FIG. 2 are becoming equivalent to single inlet chamber 33 of FIG. 1 and flow controls 86 and 87 of FIG. 2 are always in communication with the discharge line 34 of the variable displacement pump 12.

Figure 3:
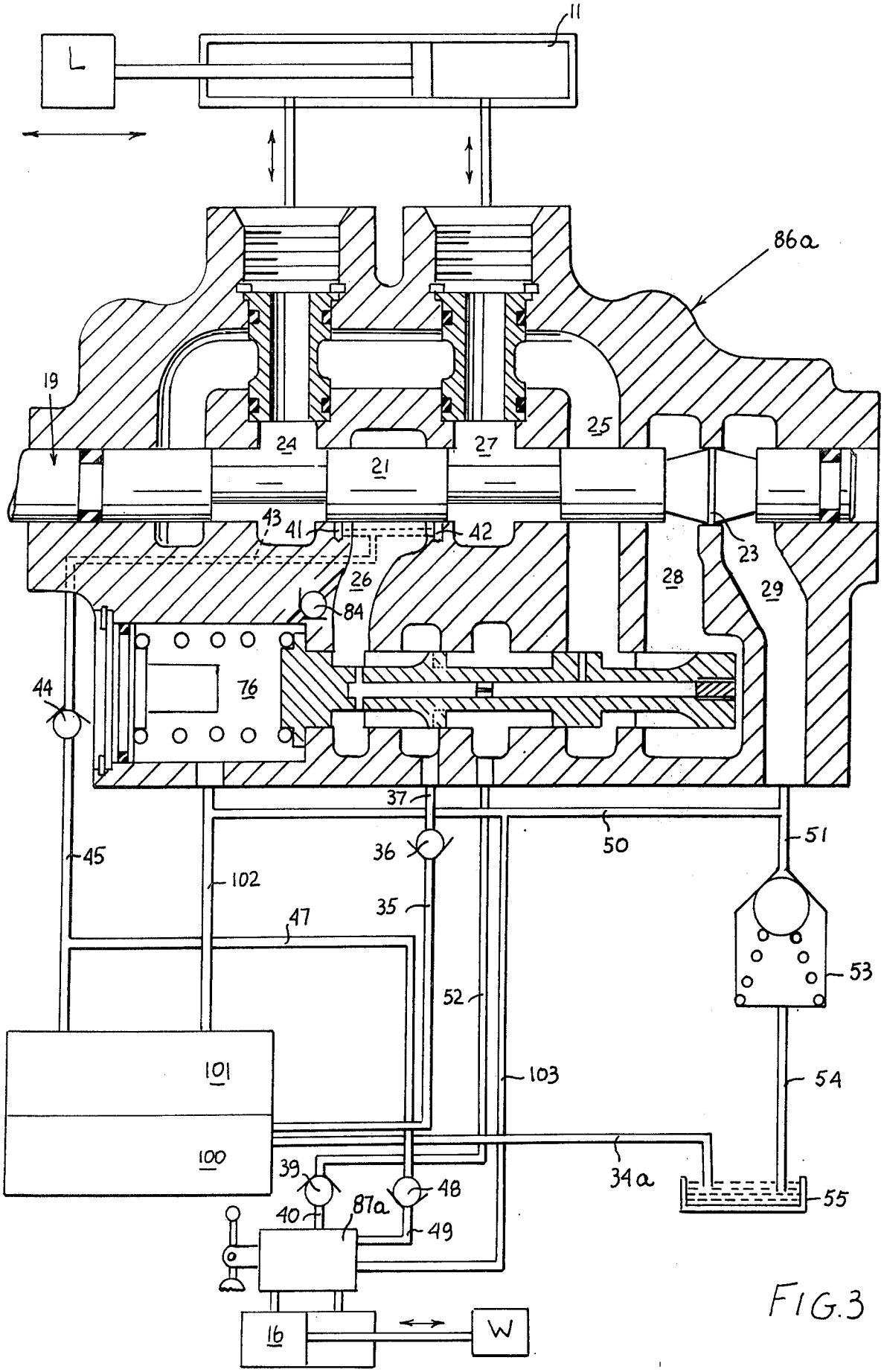
FIG. 3 is a longitudinal sectional view of a similar embodiment of flow control valve of FIG. 2 having a positive load control with priority feature and negative load control, positive and negative load controls being responsive to actuator down stream pressure, for use in load responsive fluid control system, with pressure signal lines, differential pressure relief valve, fixed displacement pump, second load responsive valve, common exhaust manifold with its exhaust relief valve and system reservoir shown diagrammatically.

Referring now to FIG. 3, flow control valves, generally designated as **86*a* and 87*a* are identical to flow control valves 86 and 87 of FIG. 2 and they perform their control functions in control of loads L and W in a similar way. The connections and operation of the exhaust manifolds, connecting exhaust lines of flow control valves 86*a* and 87*a*, are different from those of FIG. 2, since the system of FIG. 3 is powered by a fixed displacement pump 100, controlled by a differential pressure relief valve 101, well known in the art. Fluid flow from the fixed displacement pump 100 to flow control valves 86*a* and 87*a* is regulated by the differential pressure relief valve 101, which can be mounted as shown on the pump 100, or be an integral part of the flow control valve 86*a*. If the differential pressure relief valve 101 is made part of the valve assembly it is connected to the fixed displacement pump 100 by a high pressure line capable of transmitting full flow of the pump. The differential pressure relief valve 101, in a well known manner, by bypassing fluid from the fixed displacement pump 100 to the reservoir 55 maintains discharge pressure of the fixed displacement pump 100 at a level, higher by a constant pressure differential, than load pressure developed in fluid motors 11 and 16, when flow control valves 86*a* and 87*a*** are being operated.

Positive pressure sensing ports 41 and 42, identical to those of FIG. 2 transmit control signals through line 43, check valve 44 and line 45 to the differential pressure relief valve 101. In a similar manner positive load sensing ports of flow control valve **87*a* are connected through line 49, check valve 48 and lines 47 and 45 to the differential relief valve 101**.

Excess pump flow from the differential pressure relief valve 101 is delivered through line 102 to exhaust lines 50 and 51, which communicate with the second exhaust chamber 29 and exhaust space 76 of flow control valve **86*a*. Second exhaust chamber and exhaust space of flow control valve 87*a* are connected to exhaust line 50 by line 103. All the exhaust lines of flow control valves 86*a* and 87*a*, together with the line 102 conducting bypass flow from the differential pressure relief valve 101, are interconnected into a single exhaust manifold, terminating in exhaust line 51, which is blocked by exhaust pressure relief valve 53, connected by line 54 to the reservoir 55. In this way the exhaust manifold of flow control valves 86*a* and 87*a* is maintained at a constant preselected pressure level by exhaust relief valve 53. Therefore the pressurized exhaust manifold of FIG. 3 in a similar way as the exhaust manifold of FIG. 2 supplies the flow requirements of motors 11 and 16 during control of negative loads. However, since the exhaust manifold of FIG. 3 is supplied by additional flow from the differential pressure relief valve 101, all the normal inlet flow requirements of the motors 11 and 16** can be satisfied without diverting part of the pump discharge flow into the exhaust manifold.

Assume that valve spool 19 is moved very fast from left to right connecting load chamber 24 with supply chamber 26, the load chamber 27 with the outlet chamber 25 and through metering land 23 connecting the first exhaust chamber 28 with the second exhaust chamber 29. If the differential pressure relief valve 101 would not respond fast enough, to raise the pump discharge pressure to the required level, a back flow from the load chamber 24 to the fixed displacement pump 100, differential pressure relief valve 101 and through line 102 to the exhaust circuit will take place, resulting in a momentary drop in load L. This back flow is prevented by the check valve 36, which closes communication between the fluid motor 11 and the fixed displacement pump 100, until the pump control responds, raising the pump discharge pressure to the required level, as dictated by the control pressure signal transmitted from the pressure sensing port 41. Once the discharge pressure of the fixed displacement pump 100 will become greater than pressure in the load chamber 24, the check valve 36 will open and the control will resume its normal mode of operation. In a similar way the check valve 39 prevents drop in load W during fast operation of the flow control valve 87*a*.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. Multiple load responsive assemblies each comprising a housing having a fluid inlet chamber connected to pump means, a fluid supply chamber, first and second load chambers, a fluid outlet chamber, a fluid exhaust chamber, and fluid exhaust means connected to reservoir means, first valve means for selectively interconnecting said fluid load chambers with said fluid supply chamber and said fluid outlet chamber, said first valve means having variable metering orifice means operable to throttle fluid flow between said exhaust chamber and said fluid exhaust means, pressure sensing means selectively communicable with said load chambers by said first valve means, means to interconnect fluid exhaust means of all of said valve assemblies to form common exhaust manifold means, exhaust pressure relief valve means interposed between said exhaust manifold means and said reservoir means, second valve means having first throttling means between said fluid inlet chamber and said fluid supply chamber and second throttling means between said fluid outlet chamber and said fluid exhaust chamber, said second valve means being responsive to pressure in said fluid exhaust chamber and operable to maintain said pressure in said fluid exhaust chamber at a first relatively constant preselected pressure level while fluid flow is being throttled by said first throttling means and to maintain said pressure in said fluid exhaust chamber at a second relatively constant preselected pressure level while fluid flow is being throttled by said second throttling means, said second valve means having isolating means to isolate said fluid supply chamber from said fluid inlet chamber when one of said load chambers is connected to said fluid outlet chamber by said first valve means and said exhaust chamber is at a pressure higher than said first preselected pressure level, fluid replenishing means to interconnect for fluid flow said fluid supply chamber and said exhaust manifold means when said fluid isolating means isolate said fluid supply chamber from said fluid inlet chamber, and control means operationally connected to said inlet chambers of said valve assemblies, control line means interconnecting said control means with said pressure sensing means of said valve assemblies, control signal direction phasing means in each of said control line means, said control means responsive to highest pressure in any of said load chambers of valve assemblies operating loads and operable to vary fluid flow delivered from said pump means to said valve assemblies to maintain a constant pressure differential between pressure in said inlet chambers and said maximum pressure in said load chamber.

2. Multiple load responsive valve assemblies as set forth in claim 1 wherein said control means has bypass means to vary fluid flow delivered from said pump means to said valve assemblies and fluid conducting means to conduct said fluid from said bypass means to said exhaust duct means.

3. Multiple load responsive valve assemblies as set forth in claim 1 wherein said control means has pump displacement changing control means to vary fluid flow delivered from said pump means to said valve assemblies.

4. Multiple load responsive valve assemblies as set forth in claim 1 wherein constant pressure reducing valve means interconnect said inlet chambers of said valve assemblies and said exhaust manifold means upstream of said exhaust pressure relief valve means.

5. Multiple load responsive valve assemblies as set forth in claim 1 wherein check valve means are interposed between said pump means and each of said inlet chambers to prevent fluid back flow from said inlet chambers to said pump means.

6. Multiple load responsive valve assemblies as set forth in claim 1 wherein said housing has a fluid bypass chamber adjacent to said fluid inlet chamber, said second valve means having priority throttling and bypass means operable to throttle or bypass flow from said fluid inlet chamber to said fluid bypass chamber.

7. Multiple load responsive valve assemblies as set forth in claim 6 wherein said second valve means has bypass actuating means to open communication through said priority throttling and bypass means between said fluid inlet chamber and said fluid bypass chamber when said first valve means is in a neutral position and said variable orifice means remains closed.

8. Multiple load responsive valve assemblies as set forth in claim 7 wherein said bypass actuating means has positioning means of said second valve means to maintain full flow communication between said inlet chamber and said bypass chamber.

9. Multiple load responsive valve assemblies as set forth in claim 1 wherein constant pressure reducing valve means interconnect said inlet chambers of said valve assemblies and said exhaust manifold means upstream of said exhaust pressure relief valve means.

10. Multiple load responsive valve assemblies as set forth in claim 1 wherein suction check valve means interconnects said exhaust manifold means and said fluid supply chamber of each of said valve assemblies.

11. Multiple load responsive valve assemblies each comprising a housing having a fluid inlet chamber connected to pump means, said pump means having fluid output control means, a fluid supply chamber, first and second load chambers, a fluid outlet chamber, a fluid exhaust chamber, and fluid exhaust means connected to reservoir means, first valve means for selectively interconnecting said fluid load chambers with said fluid supply chamber and said fluid outlet chamber, said first valve means having variable metering orifice means operable to throttle fluid flow between said exhaust chamber and said fluid exhaust means, pressure sensing means selectively communicable with said load chambers by said first valve means and operable to transmit control load pressure signal to said fluid output control means, means to interconnect fluid exhaust means of said valve assemblies to form common exhaust manifold means, exhaust pressure relief valve means interposed between said exhaust manifold means and said reservoir means, second valve means having first throttling means between said fluid inlet chamber and said fluid supply chamber, said second valve means being responsive to pressure in said fluid exhaust chamber and operable to maintain said pressure in said fluid exhaust chamber at a first relatively constant preselected pressure level while fluid flow is being throttled by said first throttling means, said second valve means having isolating means to isolate said fluid supply chamber from said fluid inlet chamber when one of said load chambers is connected to said fluid outlet chamber by said first valve means and said exhaust chamber is at a pressure higher than said first preselected pressure level, and fluid replenishing means to interconnect for fluid flow said fluid supply chamber and said exhaust manifold means when said fluid isolating means isolate said fluid supply chamber from said fluid inlet chamber.

12. Multiple load responsive valve assemblies as set forth in claim 11 wherein constant pressure reducing valve means interconnect said inlet chambers of said valve assemblies and said exhaust manifold means upstream of said exhaust pressure relief valve means.

13. Multiple load responsive valve assemblies as set forth in claim 11 wherein suction check valve means interconnects said exhaust manifold means and said fluid supply chamber of each of said valve assemblies.

14. Multiple load responsive valve assemblies as set forth in claim 11 wherein check valve means are interposed between said pump means and each of said inlet chambers to prevent fluid back flow from said inlet chambers to said pump means.

15. Multiple load responsive valve assemblies as set forth in claim 11 wherein said second valve means has a second throttling means between said fluid outlet chamber and said fluid exhaust chamber operable to maintain said pressure in said fluid exhaust chamber at a second relatively constant preselected pressure level while fluid flow is being throttled by said second throttling means.

16. Multiple load responsive valve assemblies as set forth in claim 11 wherein control signal direction phasing means is positioned in each of said pressure sensing means operable to transmit highest load pressure signal from said valve assemblies to said fluid output control means of said pump means.

17. Multiple load responsive valve assemblies as set forth in claim 11 wherein said housing has a fluid bypass chamber adjacent to said fluid inlet chamber said second valve means having priority throttling and bypass means operable to throttle or bypass flow from said fluid inlet chamber to said fluid bypass chamber.

* * * * *